US010164383B2

(12) United States Patent
Feng

(10) Patent No.: US 10,164,383 B2
(45) Date of Patent: Dec. 25, 2018

(54) FAST PLUG CONNECTOR FOR USE WITH COPPER WIRE

(71) Applicant: HONG RU CONNECTORS CO., LTD., Dongguan (CN)

(72) Inventor: Zhu Feng, Dongguan (CN)

(73) Assignee: HONG RU CONNECTORS CO., LTD., Guangdong (CN)

( * ) Notice: Subject to any disclaimer, the term of this patent is extended or adjusted under 35 U.S.C. 154(b) by 0 days.

(21) Appl. No.: 15/619,768

(22) Filed: Jun. 12, 2017

(65) Prior Publication Data

US 2018/0205189 A1 Jul. 19, 2018

(30) Foreign Application Priority Data

Jan. 18, 2017 (CN) ..... 2017 1 0036598

(51) Int. Cl.
*H01R 24/20* (2011.01)
*H01R 24/86* (2011.01)

(52) U.S. Cl.
CPC ..... *H01R 24/20* (2013.01); *H01R 24/86* (2013.01)

(58) Field of Classification Search
CPC ..... H01R 24/84; H01R 13/28; H01R 23/27; H01R 4/4818
See application file for complete search history.

(56) References Cited

U.S. PATENT DOCUMENTS 7,988,481 B2 * 8/2011 Bethurum ..... H01R 4/4818 439/293
9,551,483 B1 * 1/2017 Mostoller ..... H01R 24/20

* cited by examiner

*Primary Examiner* — Ross N Gushi
(74) *Attorney, Agent, or Firm* — JCIPRNET

(57) ABSTRACT

Disclosed is a fast plug connector for use with copper wire, including an integrally-formed plastic-molded connector housing. The housing includes at least two terminal receiving slots juxtaposed inside the housing. The terminal receiving slots is embedded with engaging terminals having barbed pieces mounted at both tail ends thereof and twisted elastic sheets mounted at both head ends thereof. The upper end located at the left side and the right side of the head of the connector housing is mounted with fastening clamps, and a lower end located at the left side and the right side of the head of the connector housing is mounted with fastening holes that are respectively corresponding to the fastening clamps. The invention provides an electric connection using fast plug electrical connector that can be readily adapted for copper wires.

4 Claims, 4 Drawing Sheets

FAST PLUG CONNECTOR FOR USE WITH COPPER WIRE

This application claims priority for China patent application No. 201710036598.3 filed on Jan. 18, 2017, the content of which is incorporated by reference in its entirely.

FIELD OF THE INVENTION

The invention is related to an electrical connector, and more particularly to a fast plug connector for use with copper wire.

DESCRIPTION OF THE PRIOR ART

The contemporary connector for use in the electric connection technology usually requires solder or screws for the purpose of securely fastening, so as to achieve stable electric connection. Nonetheless, those connecting modes are too sophisticated and require soldering tools or screw toolkits, as well as winding processes. When it is desired to implement an electrical connection with the above-described connecting modes, the artisan will soon find out that such connecting modes are so time-consuming and cause great inconvenience. Hence, it is inclined to develop a fast plug connector to overcome the aforementioned drawbacks encountered by the prior art.

SUMMARY OF THE INVENTION

To overcome the deficiency of the prior art, an object of the invention is to provide an electric connection using fast plug electrical connector that can be readily adapted for copper wires.

The present invention proposes a technical solution to address the aforementioned technical problems. The technical solution provided by the present invention includes a connector housing that is integrally formed by a plastic-molding process and includes at least two juxtaposed terminal receiving slots located therein. Each of the terminal receiving slots is embedded with engaging terminals having barbed pieces mounted at both tail ends thereof and twisted elastic sheets mounted at both head ends thereof. The upper end located at the left side and the right side of the head of the connector housing is mounted with fastening clamps, and the lower end located at the left side and the right side of the head of the connector housing is mounted with fastening holes that are respectively corresponding to the fastening clamps.

Preferably, the elastic sheet is twisted by 90 degrees.

Preferably, the distance between the end of the barbed pieces and the inner wall at both sides of the terminal receiving slots before the connector housing is inserted into the copper wire is less than or equal to the diameter of the copper conductor within the predetermined copper wire.

Preferably, the engaging terminals have enhanced elastic sheets mounted at the rear surface of the engaging terminals. Also, the connector housing has a blocking member disposed inside the connector housing for stopping the engaging terminals from being pulled out by the prop with the enhanced elastic sheets.

The benefits of the invention are as follows. The connector housing has at least two juxtaposed terminal receiving slots inside the housing and the terminal receiving slots has embedded engaging terminals. Both tails ends of the engaging terminals are provided with barbed pieces, and both head ends of the engaging terminals are provided with twisted elastic sheets. The upper end located at the left side and the right side of the head of the connector housing is mounted with fastening clamps, and the lower end located at the left side and the right side of the head of the connector housing is mounted with fastening holes that are respectively corresponding to the fastening clamps. In this manner, the connector housing can turn 180 degree and then couple to another connector housing, so that the fastening clamps of the connector housing is fastened with the fastening hole of the opposite connector housing. Thus, twisted elastic sheets of the engaging terminals that are opposite to each other can be tightly pressed for engagement, thereby achieving easy and fast electrical connection between two connectors. Afterwards, the outer skin of the predetermined copper wires has to be peeled off and the copper conductor is inserted into the inner space between the barbed pieces and the inner wall of the connector housing. This would result in easy and fast plugging electrical connection between the connector and the wire. As the barbed pieces are able to securely fasten the copper conductor, the electrical connection would be more reliable. Thus, the electrical connector of the invention is able to provide easy, fast and reliable electrical connection.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the features and advantages of the invention. In the drawings.

DESCRIPTION OF THE PREFERRED EMBODIMENTS

Figure 1:
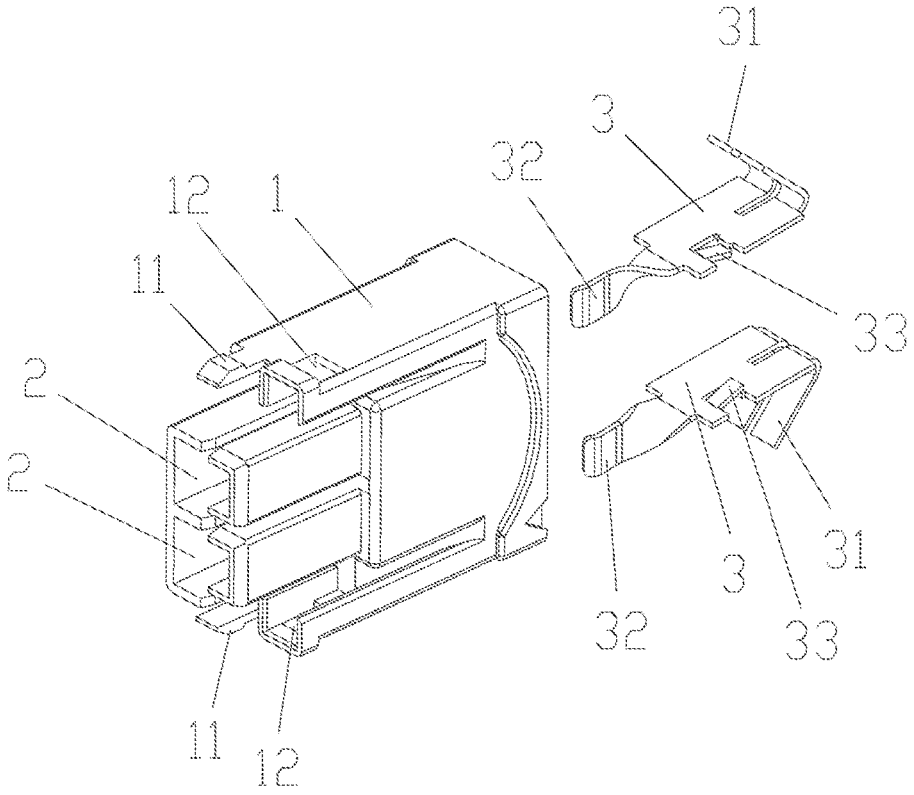
FIG. 1 is an exploded view of the connector according to the invention.
Figure 2:
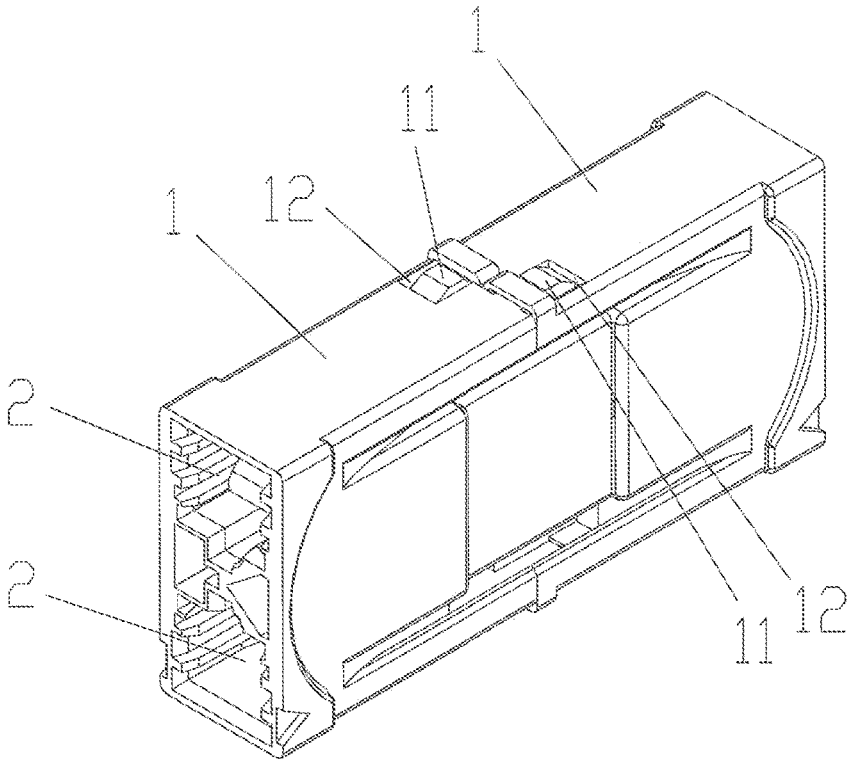
FIG. 2 is a schematic view showing the configurational structure of two connectors being coupled with each other according to the invention.
Figure 3:
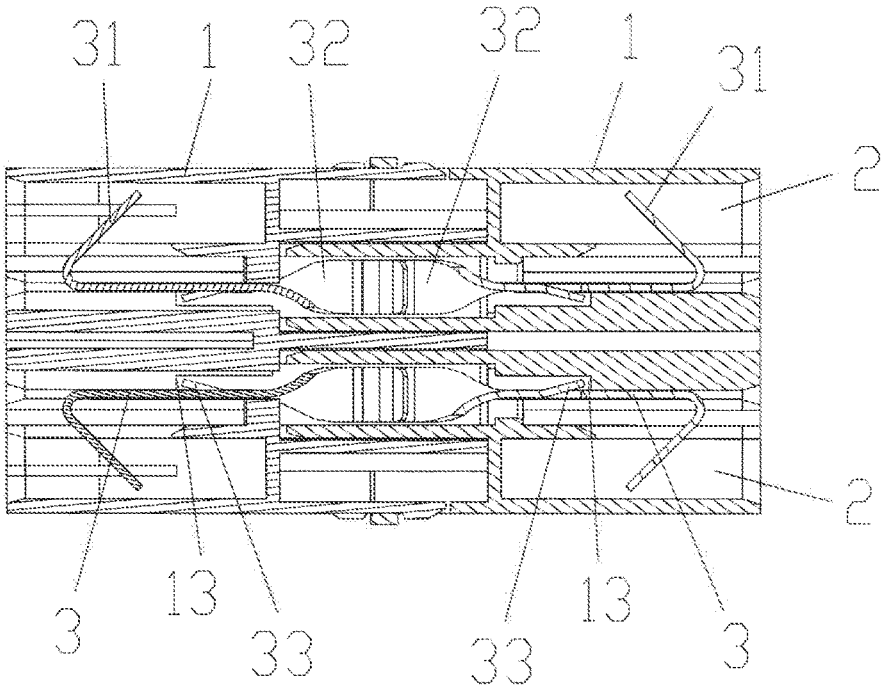
FIG. 3 is a cross-sectional view showing the profile of two connectors being coupled with each other according to the invention.
Figure 4:
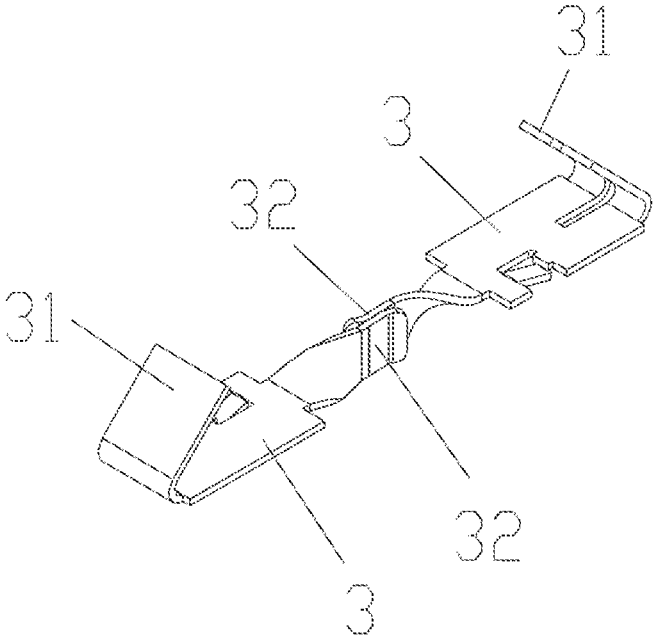
FIG. 4 is a schematic view showing the configurational structure of the heads of two connectors being coupled with each other according to the invention.

Please refer to FIG. 1 to FIG. 4. The present invention provides a fast plug connector for use with copper wire. The fast plug connector according to the invention includes an integrally-formed plastic-molded housing 1, which includes two terminal receiving slots that are juxtaposed inside the connector housing 1. A plurality of engaging terminals 3 are embedded in the terminal receiving slots 2. The engaging terminals 3 include barbed pieces 31 located at the tail ends of the engaging terminals 3. The engaging terminals 3 also include twisted elastic sheets 32 located at the head ends of the engaging terminals 3. The upper end located at the left side and the right side of the head of the connector housing is mounted with fastening clamps 11, and the lower end located at the left side and the right side of the head of the connector housing is mounted with fastening holes 12 that are respectively corresponding to the fastening clamps. The connector housing 1 can turn 180 degrees and then couple to another connector housing, so that the fastening clamps of the connector housing can be engaged with the fastening holes of the opposite connector housing. Thus, the twisted elastic sheets of the connector housing can be tightly pressed against the twisted elastic sheets of the opposite connector housing for engagement, thereby achieving easy and fast electrical connection between two electrical connectors. Afterwards, it is required that the outer skin of the copper wire is peeled off, and the copper conductor of the copper wire is inserted into the inner space between the barbed pieces and the inner wall of the connector housing. In this way, easy and fast electrical connection can be attained between the connector and the wire. As the barbed pieces are able to securely fasten the copper conductor of the copper wire, a reliable electrical connection can be realized.

Preferably, the elastic sheets are twisted by an angle of 90 degrees. In this way, the elastic sheets can be pressed against one another by way of the twist angle of the elastic sheets. Moreover, the stability of the electrical connection can be ensured through the force joining the elastic sheets by the twisted elasticity, in such a way that resembles the bridging connection using the torque of the cables over a bridge. Before the connector housing 1 is inserted into the predetermined copper wire, the distance between the end of the barbed pieces and the inner wall at both sides of the terminal receiving slots is less than or equal to the diameter of the copper conductor within the predetermined copper wire. This can ensure that a sufficient tensile strength is provided to stop the copper wire from being pulled out. The engaging terminals have enhanced elastic sheets 33 at the rear surface thereof. The connector housing also includes a blocking member 13. The enhanced elastic sheets 33 is set to prop against the blocking member 13 to stop the engaging terminals from being pulled out from the terminal receiving slots by an elastic force of the enhanced elastic sheets 33 that is applied in an opposite direction. The fastening strength between the enhanced elastic sheets 33 and the copper conductor of the copper wire makes sure that the copper conductor will not be pulled out, thereby achieving stable electrical connection.

It is to be noted that the invention is not limited to the embodiment described above. Various modification and alternatives of the invention that attain the same technical benefits with basic technical means disclosed by the invention can be made without departing from the scope of the invention.

What is claimed is:

1. A fast plug connector for use with copper wire, comprising:

a connector housing being integrally-formed and plastic-molded and having at least two terminal receiving slots juxtaposed therein;

wherein the terminal receiving slots are embedded with engaging terminals having barbed pieces located at both tail ends thereof and twisted elastic sheets located at both head ends thereof, each of the engaging terminals is extended from the tail end thereof to the head end thereof along an extending direction, each of the twisted elastic sheets is twisted about a twist axis parallel to the extending direction, and wherein an upper end located at the left side and the right side of a head of the connector housing is mounted with fastening clamps, and a lower end located at the left side and the right side of the head of the connector housing is mounted with fastening holes that are respectively corresponding to the fastening clamps.

2. The fast plug connector for use with copper wire according to claim 1, wherein a twist angle of the twisted elastic sheets relative to the twist axis is 90 degrees.

3. The fast plug connector for use with copper wire according to claim 1, wherein before a predetermined copper wire is inserted into the connector housing, a distance between an end of the barbed pieces and an inner wall at both sides of the terminal receiving slots is less than or equal to a diameter of a copper conductor within the predetermined copper wire.

4. The fast plug connector for use with copper wire according to claim 1, wherein the engaging terminals are provided with enhanced elastic sheets located at a rear surface thereof, and the connector housing includes a blocking member located therein for stopping the engaging terminals from being pulled out by engaging with the enhanced elastic sheets.

* * * * *